US005903810A

United States Patent [19]

Adachi

[11] Patent Number: 5,903,810

[45] Date of Patent: May 11, 1999

[54] FIXING DEVICE WITH A CLOSED SPACE

[75] Inventor: Takahiko Adachi, Chigasaki, Japan

[73] Assignee: Kabushiki Kaisha Toshiba, Kawasaki, Japan

[21] Appl. No.: 09/042,452

[22] Filed: Mar. 16, 1998

[30] Foreign Application Priority Data

Mar. 19, 1997 [JP] Japan ..... 9-066365

[51] Int. Cl.[6] ..... G03G 15/20

[52] U.S. Cl. ..... 399/328; 219/216; 399/94; 432/60

[58] Field of Search ..... 399/94, 331, 328; 219/216, 469; 432/60

[56] References Cited

U.S. PATENT DOCUMENTS 3,998,584 12/1976 Wada et al. ..... 432/60

FOREIGN PATENT DOCUMENTS 5-107961 4/1993 Japan .
5-188805 7/1993 Japan .

*Primary Examiner*—Joan Pendegrass
*Attorney, Agent, or Firm*—Foley & Lardner

[57] ABSTRACT

A fixing device including a heat roller for heating a sheet, a press roller, pressed against the heat roller, for pressing the sheet on the heat roller, an aluminum plate provided along the outer circumference of the press roller, so as to surround the press roller, a mold member, provided away from the aluminum plate to face thereto, for supporting the aluminum plate, and a frame, interposed between the aluminum plate and the mold member, for defining a closed space for heat insulation, between the aluminum plate and the mold member.

7 Claims, 5 Drawing Sheets

FIXING DEVICE WITH A CLOSED SPACE

BACKGROUND OF THE INVENTION

The present invention relates to a fixing device equipped in, for example, an electrophoto-copying machine.

With regard to the fixing device of an electrophoto-copying machine or the like, it is required to maintain a fixing rate while a continuous copying operation. In order to maintain the fixing rate, it is necessary to control the temperature of the fixing device within a certain range during the continuous copying operation.

The fixing device feeds a sheet between a heat roller and a press roller pressed upon the heat roller to pass between them, and thus a toner image is fixed on the sheet. A heater is provided within the heat roller, and a thermistor is arranged on the surface of the heat roller.

The temperature of the fixing device can be controlled by, first, detecting the surface temperature of the heat roller using the thermistor, and turning on or off the heater within the heat roller in accordance with the temperature detected.

It should be noted that as the copy speed of the electrophoto-copying machine increases, each sheet passes through the fixing device in a short period of time, and therefore the heat amount given from the fixing device decreases.

Further, during the continuous copying mode, the number of sheets which pass through the fixing device within a certain period of time increases, and therefore the heat amount drawn by the sheets increases, thus lowering the temperature of the fixing device as a whole.

In order to avoid the lowering of the temperature, it is effective to maintain the temperature of the press roller.

The copying machine is set in a stand-by status when the surface of the heat roller of the fixing device becomes to have a predetermined temperature. At the same time, the surface of the press roller which is in contact with the heat roller is heated to the surface temperature of the heat roller.

However, when copying is started, sheets absorb heat of the heat roller and press roller, and further, the heat of the heat roller is absorbed not only by the sheets but also by the press roller which is in contact with the heat roller.

Under these circumstances, when the heat of the press roller which is once heated when a copying operation is started, can be kept, it becomes possible not only to decrease the heat amount absorbed from the heat roller to the press roller, but also to increase the heat amount given from the press roller to sheets.

An example of the technique of keeping the temperature of the press roller, is to enclose a press roller by a heat insulating member.

This technique is further divided into two versions. In one version, heat is reserved by a U-shaped bracket (sheet metal) which is provided to enclose a press roller, with a felt material is adhered on the inner surface of the bracket, and an aluminum foil adhered on the surface of the felt material, whereas in the other version, a press roller is enclosed by a U-shaped aluminum plate.

The U-shaped bracket or the U-shaped aluminum plate, mentioned above, is fixed to a fixation frame with a screw or the like.

However, when the U-shaped bracket or the U-shaped aluminum plate is fixed to the fixation frame with a screw, the radiation heat of the press roller is easily radiated to the fixation frame from the bracket or the aluminum plate via the fixation screw.

As a result, such a technique entails the drawback of a poor heat reserving effect of the press roller, which causes a decrease in the fixation rate in a high-speed copying mode or a continuous copying mode.

BRIEF SUMMARY OF THE INVENTION

The present invention has been achieved in consideration of the above-described status of the conventional case, and the object thereof is to provide a fixing device having an improved fixing efficiency, achieved by fully reserving the heat of the press roller.

In order to solve the drawback of the conventional technique, the first version of the present invention provides a fixing device comprising: a heat roller for heating a fixation material; a press roller, provided to be pressed against the heat roller, for pressing the fixation material, on the heat roller; a first member provided along an outer circumference of the press roller, so as to surround the press roller; a second member, provided away from the first member to face thereto, for supporting the first member; and a frame member, interposed between the first and second members, for defining a closed space for heat insulation.

Further, the second version of the present invention provides a fixing device comprising: a heat roller for heating a fixation material; a press roller, provided to be pressed against the heat roller, for pressing the fixation material on the heat roller; a heat insulating member provided along an outer circumference of the press roller, so as to surround the press roller; a supporting member, provided away from the heat insulating member to face thereto, for supporting the heat insulating member; and a frame member, interposed between the heat insulating member and the supporting members, and set on parts of the heat insulating member and supporting member, for defining a closed space for heat insulation, between the heat insulating member and the supporting member.

Furthermore, the third version of the present invention provides a fixing device comprising: a heat roller for heating a fixation material; a press roller, provided to be pressed against the heat roller, for pressing the fixation material on the heat roller; a heat insulating member provided along an outer circumference of the press roller, so as to surround the press roller; a supporting member, provided away from the heat insulating member to face thereto, for movably supporting the heat insulating member; and an expandable frame, interposed between the heat insulating member and the supporting members, and set on parts of the heat insulating member and supporting member, for defining a closed space for heat insulation, between the heat insulating member and the supporting member.

Furthermore, the fourth version of the present invention provides a fixing device comprising: a heat roller for heating a fixation material; a press roller, provided to be pressed against the heat roller, for pressing the fixation material on the heat roller; a heat insulating member provided along an outer circumference of the press roller, so as to surround the press roller; a supporting member, provided away from the heat insulating member to face thereto, for supporting the heat insulating member; a frame member, interposed between the heat insulating member and the supporting members, and set on parts of the heat insulating member and supporting member, for defining a closed space for heat insulation, between the heat insulating member and the supporting member; a cavity, made in the supporting member to be communicated to outside, for releasing pressure; and a closing member for closing the cavity for releasing the pressure, the closing member being elastically deformed towards an inside of the cavity for releasing the pressure when an air contained in the closed space is thermally expanded.

As described above, in the present invention, the first and second members (heat insulating member and supporting member) are provided to enclose the press roller, and the frame member is interposed between the first and second members to define the closed space, which serves to insulate and reserve the heat of the press roller. With this structure, the amount of heat radiation from the press roller can be remarkably decreased.

Further, the cavity for discharging the expansion pressure is provided for the supporting member, and the cavity is closed by the closing member, such that the closing member is elastically deformed towards the inside of the cavity for discharging the pressure when the air within the closed space is thermally expanded. With this structure, the expansion pressure can be released, and therefore the heat insulating member can be avoided from being pushed towards the press roller due to the expansion pressure.

Further, the frame member which defines the closed space as it is interposed between the heat insulating member and the supporting member, is made expandable, and therefore the frame member expands even if the heat insulating member is brought into contact with the press roller, thus the rotation of the press roller is never disturbed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described in detail with reference to the accompanying drawings.

Figure 1:
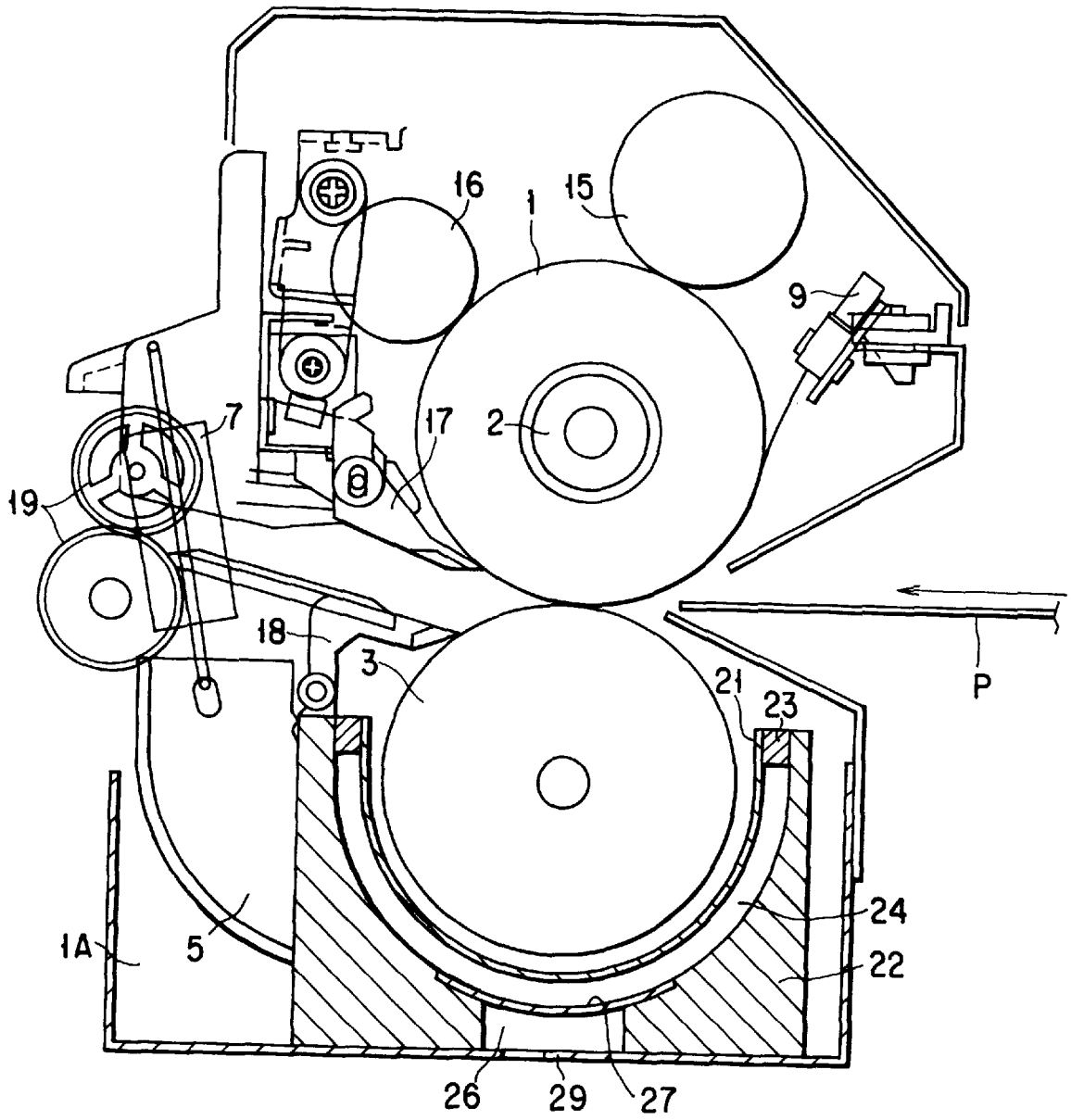
FIG. 1 is a diagram showing the structure of a fixing device according to an embodiment of the present invention.

FIG. 1 is a diagram showing the structure of the fixing device.

This figure illustrates a fixation frame 1A, inside of which a heat roller 1 and a press roller 3 pressed against the heat roller 1, are arranged. Further, a heat lamp 2 for heating the heat roller 1 is provided within the heat roller 1. Both end portions of the press roller 3 are each supported by a press lever 5. A spring 7 designed to press the press roller 3 against the heat roller 1 at a force of about 60 Kg, is connected to each press lever 5.

A thermistor 9 is brought into contact with the heat roller 1 so as to detect the temperature of the heat roller 1. The heater lamp 2 is kept on until the thermistor 9 detects a temperature of 190°, and when the thermistor detects 190°, it is turned off.

An oil supplying roller 15 for supplying oil, and a web 16 for eliminating remainder are brought into contact with the heat roller 1. A release nails 17 and 18 for releasing a sheet from the heat roller 1 and the press roller 3 are brought into contact with the sheet discharge sides of the heat roller 1 and the press roller 3. Further, a pair of sheet discharge rollers 19 are provided on the sheet discharging direction.

For the fixation of an image, a sheet P on which the image is transferred is fed between the heat roller 1 and the press roller 3. The sheet P is permitted to pass between the heat roller 1 and the press roller 3, and the transferred image is heated and pressed onto the sheet P to be fixed. The sheet P on which the image is fixed, is released from the heat roller 1 or the press roller 3 by the releasing nail 17 or 18, and then discharged to outside via the pair of the sheet discharging rollers 19.

Figure 2:
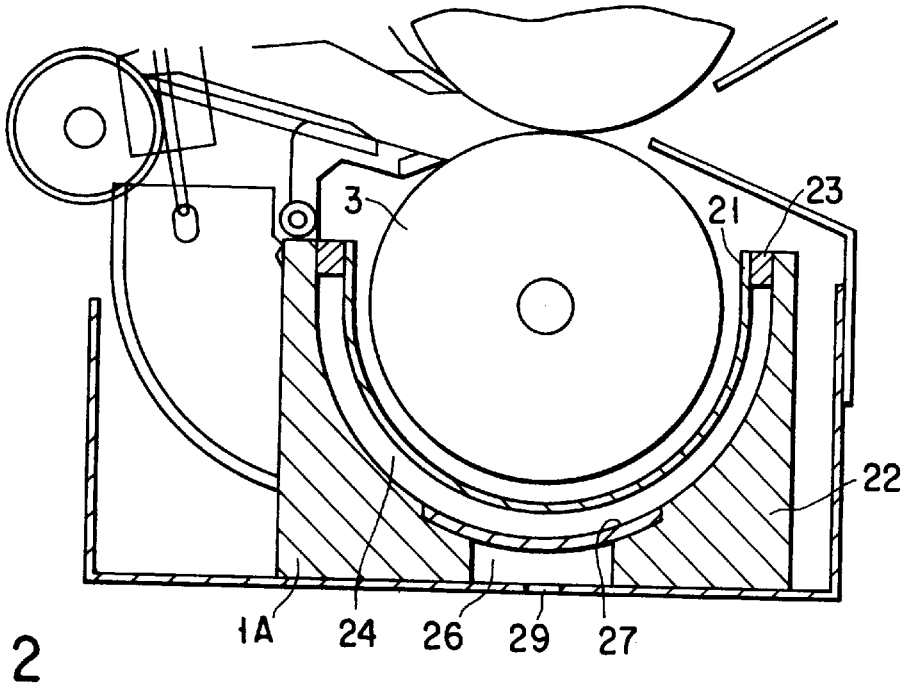
FIG. 2 is a diagram showing the heat preserving structure of t heat roller.
Figure 3:
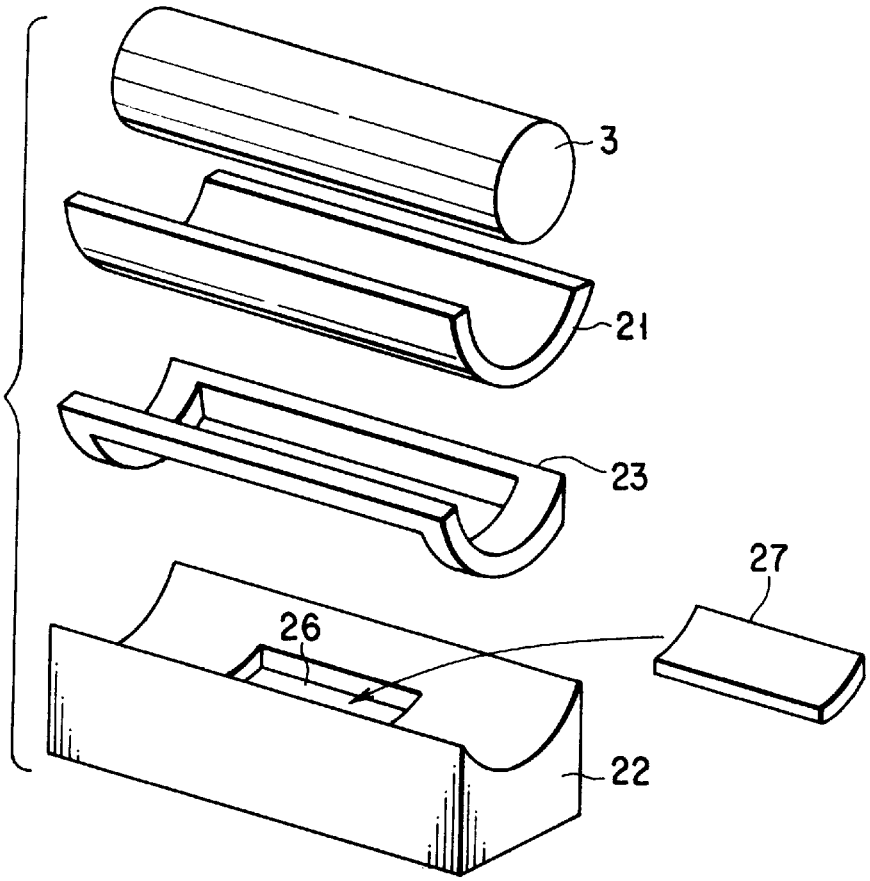
FIG. 3 is a perspective view of the heat preserving structure of the heat roller, which is decomposed into pieces.

FIG. 2 is a cross sectional view showing the heat insulating structure of the press roller 3, and FIG. 3 is a perspective view of the structure decomposed.

The lower half of the circumferential section of the press roller 3 is surrounded by an aluminum plate (or an aluminum deposited Mylar) 21 serving as a heat insulating member, that is, the first member. The surface of the aluminum plate 21 is mirror-polished.

The aluminum plate 21 is supported by a mold member 22 serving as a support member, that is, the second member. A rubber frame 23 having a low heat conductivity, and serving as a frame member, is interposed between the upper end portions of the aluminum plate 21 and the mold member 22. A closed space 24 for heat insulation is defined by the aluminum plate 21, the mold member 22 and the rubber frame 23.

For the fixation, the aluminum plate 21 is heated with the heat of the press roller 3. However, the heat of the aluminum plate 21 is insulated by the rubber frame 23 and the air layer in the closed space 24. With this structure, the heat of the aluminum plate 21 is not directly transmitted to the frame 1A of the fixing device, thus decreasing the amount of heat radiated.

It should be noted that the air in the closed space 24 is expanded when heat is applied thereto. If the air is expanded, the aluminum plate 21 is pushed upward to be brought into contact with the press roller 3, possibly causing a heavy load thereon.

Figure 4:
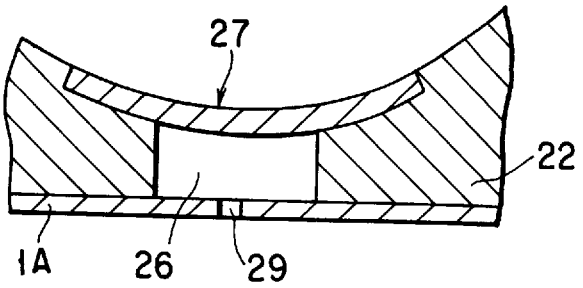
FIG. 4 is a cross sectional view showing a cavity for discharging the expansion pressure.

In order to avoid the aluminum plate 21 from being pushed upwards by the pressure of the air thermally expanded, a cavity 26 for discharging the expansion pressure is provided for the mold member 22 as shown in FIG. 4. An air discharging pore 29 serving to communicate the cavity 26 to outside atmosphere is made in the bottom portion of the frame 1A of the fixing device. The cavity for discharging the expansion pressure is closed by a rubber sheet 27 serving as a closing member. The rubber sheet 27 used here has a heat resisting property, and a thickness of 0.3 mm to 0.7 mm.

Figure 5:
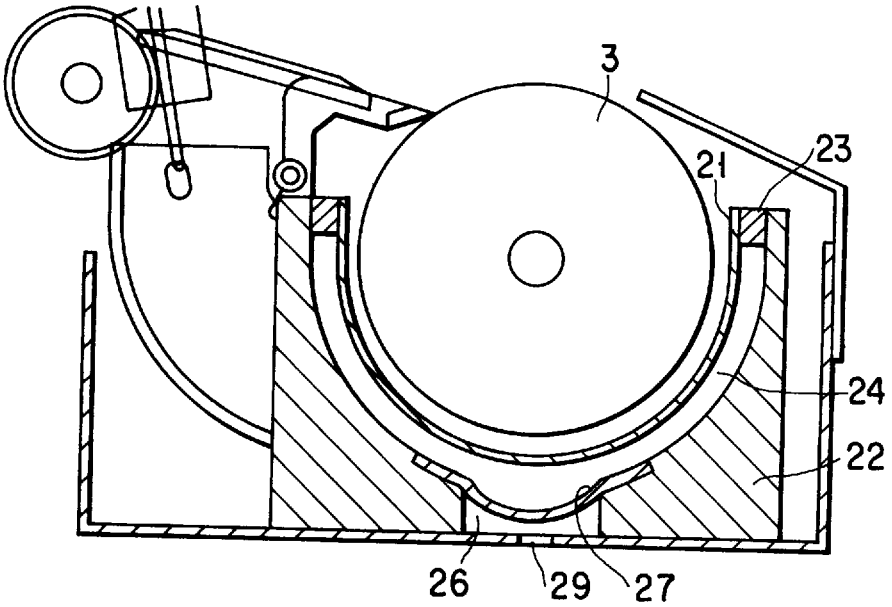
FIG. 5 is a diagram showing a deformed state of the enclosing member of the cavity for discharging the expansion pressure.

In the fixation of image, when the air contained in the closed space 24 is thermally expanded, the rubber sheet 27 is pressed due to the pressure, and elastically deformed towards the cavity 26 as can be seen in FIG. 5. Consequently, the air in the cavity 26 is discharged from a discharge outlet 29 of the frame 1A of the fixing device. Thus, the aluminum plate 21 is not pressed upwards by the air pressure within the closed space 24, and the plate 21 is prevented from being brought into contact with the press roller 3.

Figure 6:
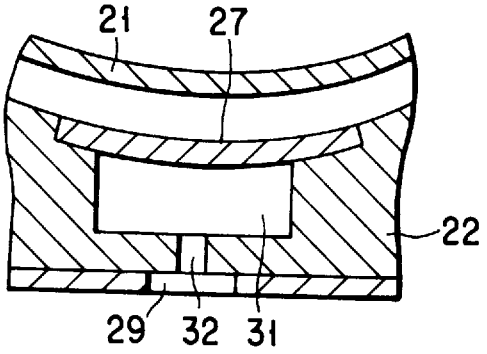
FIG. 6 is a cross sectional view showing another version of the cavity for discharging the expansion pressure.

FIG. 6 is a diagram showing another version of the cavity for discharging the expansion pressure.

In this version, the cavity 31 for discharging the expansion pressure is made to have a recessed shape, and is communicated via a communication pore 32 to an air discharge outlet 29 of the frame 1 of the fixing device.

Figure 7:
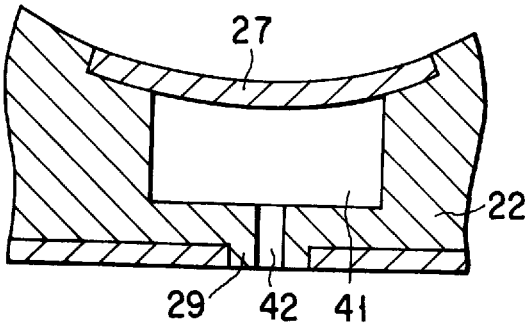
FIG. 7 is a cross sectional view showing still another version of the cavity for discharging the expansion pressure.

FIG. 7 is a diagram showing still another version of the cavity for discharging the expansion pressure.

In this version, the cavity 41 for discharging the expansion pressure is made to have a recessed shape, and is communicated via a communication pore 42 to an air discharge outlet 29 of the frame 1 of the fixing device, as in the case shown in FIG. 6.

In this version, a portion of the mold member 22 is fitted in the air discharge outlet 29. With this structure, the mold member 22 and the heat insulating member 21 can be aligned accurately with respect to the frame 1A of the fixing device.

Figure 8:
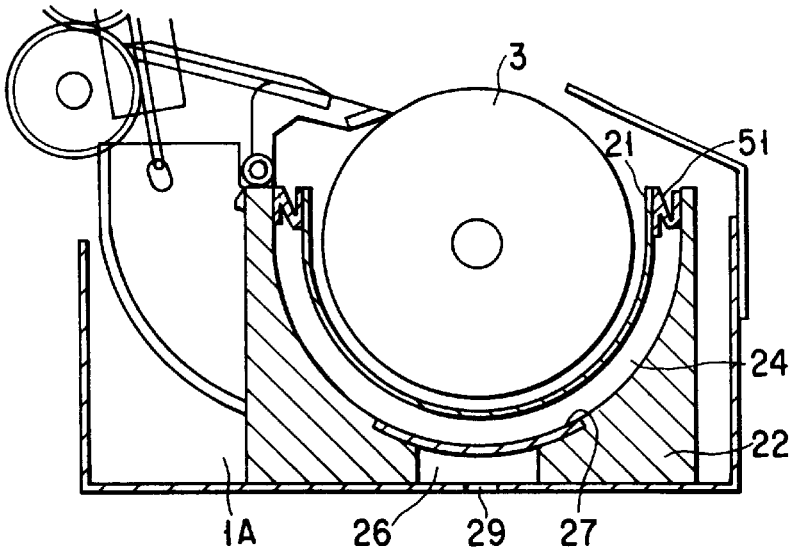
FIG. 8 is a cross sectional view showing another version of the frame body.

FIG. 8 shows another version of the rubber frame which constitutes the closed space 24.

In this version, the rubber frame 51 is made expandable in a wavy form.

In order to improve the heat insulating effect of the heat roller 3, the insulating member 21 should be located as close as possible to the press roller 3. However, in consideration of the accuracy of parts in designing, and to avoid a heavy load caused as the heat insulating member 21 is brought into contact with the press roller 3, the distance between the press roller 3 and the heat insulating member 21 is set to 4 mm or more in the conventional technique.

In this embodiment of the present invention, the rubber frame 51 is made expandable in a wavy form, and thus the distance between the press roller 3 and the heat insulating member 21 is set to 1 mm to 2 mm.

Figure 9:
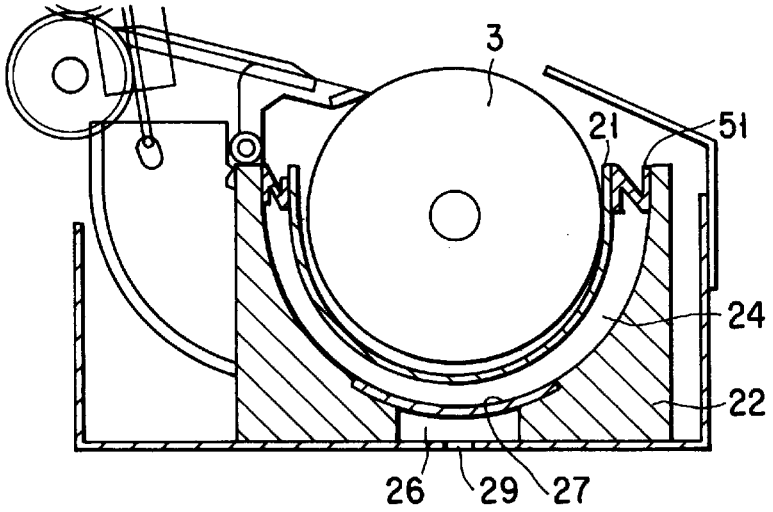
FIG. 9 is a diagram showing a state in which the heat insulating member is brought into contact with the press roller.
Figure 10:
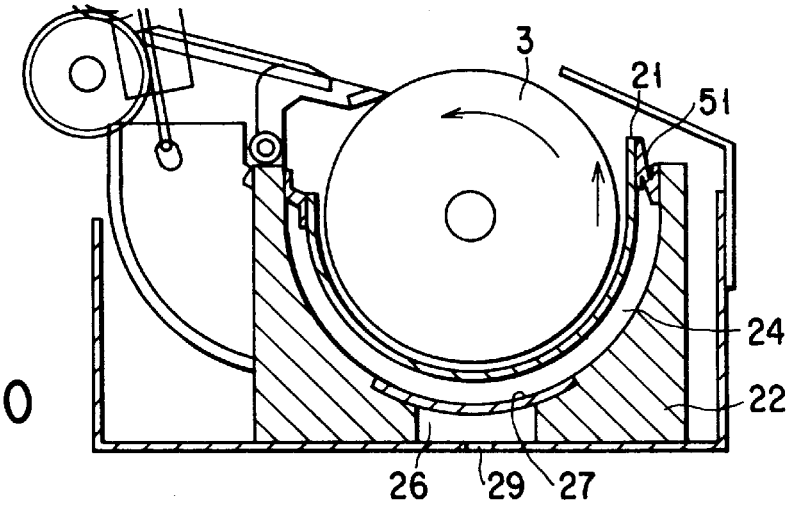
FIG. 10 is a diagram showing a state in which the heat insulating member is moved as the press roller is rotated, thus elongating the frame body.

In other words, even if the press roller 3 and the heat insulating member 21 are brought into contact with each other due to a low accuracy of the parts, as shown in FIG. 9, the heat insulating member 21 and the wavy formed rubber frame 51 are moved upwards as the press roller 3 rotates. With this structure, the rotation of the press roller 3 cannot be disturbed, and therefore it is possible to prevent a heavy load from being created.

Figure 11:
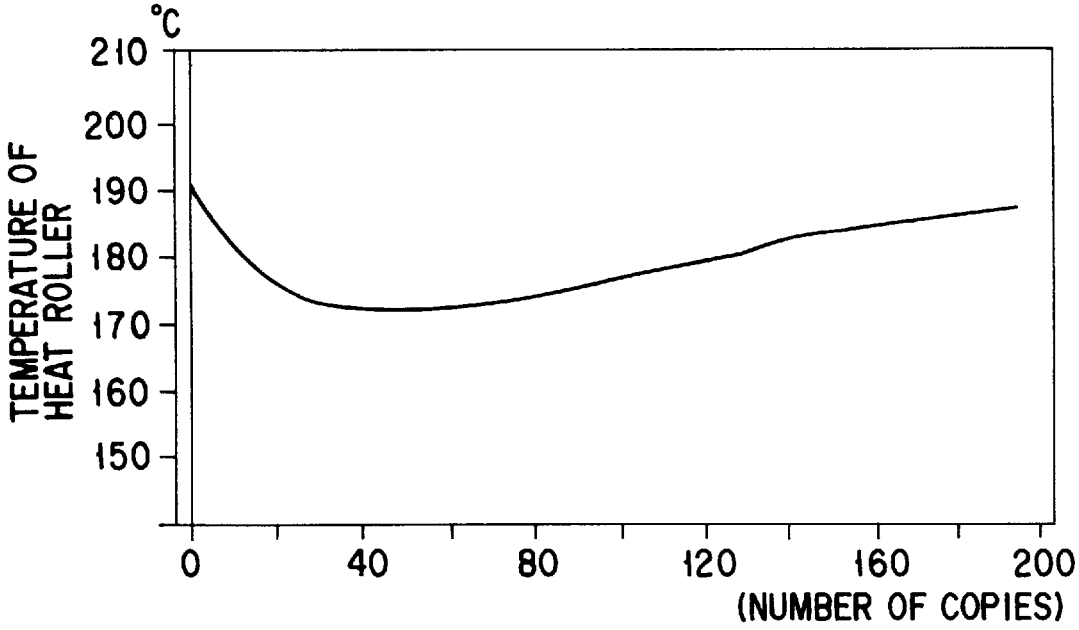
FIG. 11 is a graph illustrating the relationship between the number of copies and the temperature of the heat roller.
Figure 12:
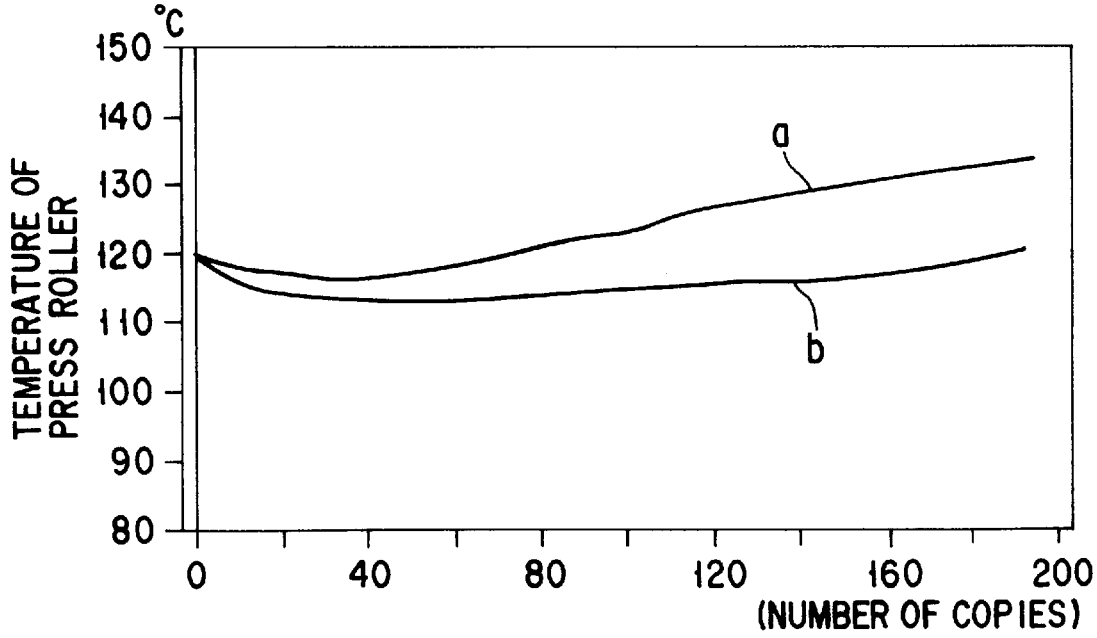
FIG. 12 is a graph illustrating the relationship between the number of copies and the temperature of the press roller.

FIG. 11 is a graph illustrating the temperature of the heat roller 1 during a continuous copying operation, and FIG. 12 is a graph showing the temperature of the press roller 3 during a continuous copying operation.

From these figures, it can be understood that, when the copying machine is set in a stand-by mode, the surface temperature of the heat roller 1 is 190°. Meanwhile, with regard to the surface temperature of the press roller 3, the temperature of the section which is in contact with the heat roller 1 is also at 190°, whereas the other section has a temperature of 120°.

When a copying operation is started, the temperature of the heat roller 1 is drastically lowered since sheets absorb heat.

However, the thermistor 9 detects the lowering of the temperature, and the heater lamp 2 built in the heat roller 1 is turned on, and kept on until the temperature of the heat roller 2 reaches 190°. During the continuous copying operation, the heat of the heat roller 1 is continuously absorbed inevitably by sheets and the press roller 3, and therefore the rise of the temperature is gradual as shown in FIG. 11. Meanwhile, the surface temperature of the press roller 3 is once decreased as indicated by line a in FIG. 12 when the copying operation is started, since sheets take heat away. However, then, the press roller 3 keeps on absorbing heat from the heat roller 2, and therefore the surface temperature of the press roller 3 gradually increases as in the case of the heat roller 2.

It should be noted that line b in FIG. 12 indicates a change in the temperature of a conventional press roller, and as shown, the temperature is lower the temperature of the press roller 3 of the present invention, indicated by line a, as they change during the operation.

As described above, the heat of the press roller 3 is reserved by the closed space 24, and therefore the heat radiation from the press roller 3 can be made as less as possible.

Therefore, as indicated by line a in FIG. 12, the slope of the curve, which indicates the temperature rise of the press roller 3, can be made steeper, and thus the surface temperature of the press roller 3 during the continuous copying operation can be increased in its entirety. Consequently, the fixing efficiency for the continuous copying operation can be improved.

As described above, the present invention has a structure in which the aluminum plate 21 and the mold member 22 are provided to enclose the press roller 3, and the frame member 23 is interposed between the aluminum plate 21 and the mold member 22 to define the closed space 24, which serves to insulate and reserve the heat of the press roller 3. With this structure, the amount of heat radiation from the press roller 3 can be remarkably decreased.

Therefore, the surface temperature of the press roller 3 during the continuous copying operation can be increased in the entirely of the operation, thus making it possible to enhance the fixing efficiency during a continuous copying operation.

Further, in the case where the cavity 26 for discharging the expansion pressure is provided for the mold member 22, and the cavity 26 is closed by the rubber sheet 27, such that the rubber sheet 27 is elastically deformed towards the inside of the cavity 26 for discharging the pressure when the air within the closed space 24 is thermally expanded. With this structure, the expansion pressure can be released, and therefore the aluminum plate 21 can be avoided from being pushed towards the press roller 3 due to the expansion pressure.

Further, in the case where the frame member 51 which defines the closed space 24 as it is interposed between the aluminum plate 21 and the mole member 22, is made expandable, the frame member 51 expands even if the aluminum plate 21 is brought into contact with the press roller 3, and therefore the rotation of the press roller 3 is never disturbed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A fixing device comprising:

a heat roller for heating a fixation material;

a press roller, provided to be pressed against the heat roller, for pressing said fixation material, on said heat roller;

a first member provided along an outer circumference of the press roller, so as to surround the press roller;

a second member, provided away from the first member to face thereto, for supporting the first member; and a frame member which makes up a closed space which is closed in all directions of a shaft and circumference of the press roller, by interposing the frame member between the first and second members such that both sides of the frame member correspond to side portions of the first and second member which are along the axial direction of the press roller, and that both ends of the frame member correspond to end portions of the first and second member which are along the circumferential direction of the press roller.

2. A fixing device according to claim 1, wherein the first member is mirror-polished and the second member has a low heat conductivity.

3. A fixing device according to claim 1, wherein the frame member is made of a rubber material having a heat resisting property.

4. A fixing device comprising:

a heat roller for heating a fixation material;

a press roller, provided to be pressed against the heat roller, for pressing said fixation material on said heat roller;

a heat insulating member provided along an outer circumference of the press roller, so as to surround the press roller;

a supporting member, provided away from the heat insulating member to face thereto, for supporting the heat insulating member; and a frame member which makes up a closed space which is closed in all directions of a shaft and circumference of the press roller, by interposing the frame member between the heat insulating member and the supporting member such that both sides of the frame member correspond to side portions of the heat insulating member and the supporting member which are along the axial direction of the press roller, and that both ends of the frame member correspond to end portions of the heat insulating member and the supporting member which are along the circumferential direction of the press roller.

5. A fixing device according to claim 4, wherein the heat insulating member is mirror-polished and the supporting member is a mold member having a low heat conductivity.

6. A fixing device comprising:

a heat roller for heating a fixation material;

a press roller, provided to be pressed against the heat roller, for pressing said fixation material on said heat roller;

a heat insulating member provided along an outer circumference of the press roller, so as to surround the press roller;

a supporting member, provided away from the heat insulating member to face thereto, for movably supporting the heat insulating member; and an expandable frame, interposed between the heat insulating member and the supporting members, and set on parts of the heat insulating member and supporting member, for defining a closed space for heat insulation, between the heat insulating member and the supporting member.

7. A fixing device comprising:

a heat roller for heating a fixation material;

a press roller, provided to be pressed against the heat roller, for pressing said fixation material on said heat roller;

a heat insulating member provided along an outer circumference of the press roller, so as to surround the press roller;

a supporting member, provided away from the heat insulating member to face thereto, for supporting the heat insulating member;

a frame, interposed between the heat insulating member and the supporting members, and set on parts of the heat insulating member and supporting member, for defining a closed space for heat insulation, between the heat insulating member and the supporting member;

a cavity, made in the supporting member to be communicated to outside, for releasing pressure; and a closing member for closing the cavity for releasing the pressure, said closing member being elastically deformed towards an inside of the cavity for releasing the pressure when an air contained in the closed space is thermally expanded.

* * * * *